US005709021A

United States Patent [19]

DiCello et al.

[11] Patent Number: 5,709,021

[45] Date of Patent: Jan. 20, 1998

[54] PROCESS FOR THE MANUFACTURE OF METAL TUBES

[75] Inventors: John A. DiCello, Los Altos; Bhupinder S. Minhas, Union City; Jeffrey W. Simpson, Mountain View; Rajendra S. Cornelius, Los Altos; John D. Harrison, Watsonville, all of Calif.

[73] Assignee: Memry Corp., Brookfield, Conn.

[21] Appl. No.: 241,109

[22] Filed: May 11, 1994

[51] Int. Cl.[6] ..... B23P 17/00

[52] U.S. Cl. ..... 29/423; 29/890.053; 138/177; 72/370

[58] Field of Search ..... 29/473, 890.053, 29/426.6; 72/370, 264; 138/177, DIG. 11

[56] References Cited

U.S. PATENT DOCUMENTS

| | | | |
|---|---|---|---|
| 2,809,750 | 10/1957 | Arenz | 72/264 |
| 4,186,586 | 2/1980 | Takamura et al. | 29/423 |
| 4,300,378 | 11/1981 | Thiruvarudchelvan | 72/264 |
| 4,653,305 | 3/1987 | Kanamaru et al. | 72/264 |
| 5,056,209 | 10/1991 | Ohashi et al. | 29/890.053 |

FOREIGN PATENT DOCUMENTS

| | | |
|---|---|---|
| 980957 | 5/1951 | France . |
| 362539 | 10/1931 | United Kingdom . |

OTHER PUBLICATIONS

Patent Abstracts of Japan vol. 12 No. 52 (M-668), 17 Feb. 1988 & JP, A, 62199218 (Furukawa Electric Co LTD) 2 Sep. 1987.

*Primary Examiner*—David P. Bryant
*Assistant Examiner*—Marc W. Butler
*Attorney, Agent, or Firm*—Jerry Cohen

[57] ABSTRACT

A seamless metal tube is made by elongating an assembly of a tube blank and a metal core by mechanical working, and then stretching the core plastically so that it diminishes in diameter sufficiently to permit its removal from the tube. The core metal is preferably a shape memory alloy.

21 Claims, 2 Drawing Sheets

PROCESS FOR THE MANUFACTURE OF METAL TUBES

BACKGROUND OF THE INVENTION

1. Field of the Invention

This invention relates to the manufacture of seamless metal tubes.

2. Introduction to the Invention

Most seamless metal tubes are made by working a tube blank over a non-deformable mandrel. (The term "metal" is used throughout this specification to refer to single metals and to alloys and intermetallic compounds of two or more different metals.) Such discontinuous processes are slow and expensive, and can only produce tubes of limited length. It is also known to make seamless tubes of uniform cross section by mechanical working of an assembly of a core and a tube blank, thus elongating both the core and the tube blank, and then removing the core. However, such processes suffer from serious problems in the final step of removing the core. Core removal has been achieved by melting a core which melts at a temperature below the melting point of the tube, or by selectively dissolving the core, but both methods are slow and inconvenient, leave a residue on the inside of the tube, and can be used only with a limited number of core/tube combinations.

SUMMARY OF THE INVENTION

We have discovered, in accordance with the present invention, that these problems can be overcome by making use of a core which, after it has been mechanically worked with the tube blank to elongate the starting assembly, is converted into a stable stretched condition throughout its length, and as a result becomes thin enough to be removed from the tube. The invention can be used to make metal tubes having a wide range of sizes, but is particularly useful for making thin wall tubes of small diameter, for example of inner diameter from 0.005 to 0.5 inch (0.13 to 12.7 mm), e.g. 0.005 to 0.125 inch (0.13 to 3.2 mm) and wall thickness 0.002 to 0.2 inch (0.05 to 5 mm), e.g. 0.002 to 0.1 inch (0.05 to 2.5 mm). The length of the tube can vary widely. Thus the invention can be used to make tubes of considerable length, e.g. more than 20 feet, or even more than 100 feet, with the upper limit being set by the equipment available to stretch the core. The tube can be of constant cross section, or part or all of the tube can be tapered.

A tube comprising a tapered section can be prepared by cutting a section from an assembly which has been elongated to the desired maximum diameter, and then subjecting part or all of the cut section to mechanical working which results in a continuous or stepped taper, e.g. tapered-die swaging, or drawing the assembly partially through a succession of dies of decreasing diameter. The core is then removed by stretching. This results in a tapered tube in which the ratio of the outside diameter to the inside diameter in the tapered section is substan.tialty constant; such tapered tubes are novel per se and form part of the present invention.

The core can be converted into a stable stretched condition in any appropriate way. Generally, the first step, unless the mechanical working has been carried out under conditions such that the core is sufficiently free from stress to be satisfactorily stretched, is to heat the core to relieve at least some of the stresses therein. The core is then stretched. In a first embodiment, the core is stretched in a single step, or in a series of two or more steps, without any treatment between the steps which substantially changes the response of the core to further stretching. In a second embodiment, the core is stretched in two or more steps, at least one pair of the stretching steps being separated by a modification step which removes at least some of the stresses induced by the previous stretching, or which in some other way decreases the force needed to induce further stretching; in this second embodiment there will usually be a plurality of stretching steps, each of which (except, optionally, the last) is followed by a modification step,, typically a heating step.

In both these embodiments, the stretching must cause sufficient plastic elongation of the core (and, therefore, a corresponding reduction in its diameter), throughout the length of the core, to permit removal of the core from the tube. The terms "plastic elongation" "stretch plastically" and the like are used herein to denote elongation which is not recovered when the stretching forces are removed and no other change is made in the conditions present during the stretching. Thus the term includes elongation which is wholly or partially recoverable by not only removing the stretching forces but also changing other ambient conditions; for example the core can be made of a shape memory alloy, e.g. one comprising titanium and nickel, which can be elongated at one temperature and retains at least part of that elongation at that temperature after removal of the stretching forces, but will recover at least part of the retained elongation if heated to a higher temperature after removal of the stretching forces. The stretching can cause not only the desired plastic elongation but also elastic elongation which is recovered when the stretching forces are removed.

In a third embodiment, the core is stretched elastically, or both elastically and plastically, throughout its length, in one or more steps carried out under a first set of conditions and is then subjected (while still subject to stretching forces) to a second set of conditions which results in at least part of the elastic stretching becoming stable, at least under the second set of conditions. Again, there must be a sufficient reduction in the diameter of the core to permit its removal from the tube.

The invention also includes methods in which the stretching is carried out in a combination of steps, each of the steps being as defined in any two or all three of the first, second and third embodiments.

A tube prepared in accordance with the present invention can of course be subjected to further processing by one or more methods known to those skilled in the art, e.g. steam cleaning to remove residual lubricants, chemical treatment to modify its surface, mechanical treatment to modify its cross section, and thermal treatment to modify its mechanical and physical properties.

Tubes prepared by the process of the invention, unlike tubes made by many other processes, can be substantially free from surface imperfections, including those which can function as stress risers. When the tube is made from a nickel-titanium or other superelastic alloy, it is remarkably flexible and kink-resistant, and is, therefore, particularly useful in applications which make use of these properties. For example, the tube can be deformed repeatedly (often more than 5%, even as much as 8%) and still return to substantially its original shape. Furthermore, the tube will often show such properties at the body temperature of human beings (and other mammals), making it particularly suitable for use in medical instruments, including catheters and laparoscopic instruments.

In a preferred aspect, this invention provides a method of making a metal tube which comprises (A) providing an assembly which comprises (1) a metal tube blank, and (2) an elongate metal core which is surrounded and contacted by the tube blank;

(B) elongating the assembly by mechanical working thereof until the tube blank has been converted into a tube of desired dimensions;

(C) after step (B), subjecting the core to a treatment which (i) results in the core being in a stable stretched condition throughout its length, and (ii) does not substantially stretch the tube; and (D) removing the stretched core from the tube.

In step (D), the stretched core is preferably physically withdrawn from the tube, without any additional treatment. However, the invention includes the possibility of an additional step which reduces the diameter of the core and/or increases the inner diameter of the tube, or the removal of at least part of the core in some other way, e.g. by a chemical treatment, which is facilitated by the gap between the tube and the stretched core.

The invention also includes an assembly which comprises (1) a metal tube blank, and (2) an elongate metal core which is surrounded and contacted by the tube blank and which is composed of a metal such that, after the assembly has been elongated by mechanical working thereof, the core can be converted into a stable stretched condition which permits the core to be physically withdrawn from the tube.

BRIEF DESCRIPTION OF THE DRAWING

The invention is illustrated in the accompanying drawings, in which.

DETAILED DESCRIPTION OF THE INVENTION

Core Metals

Figure 1:
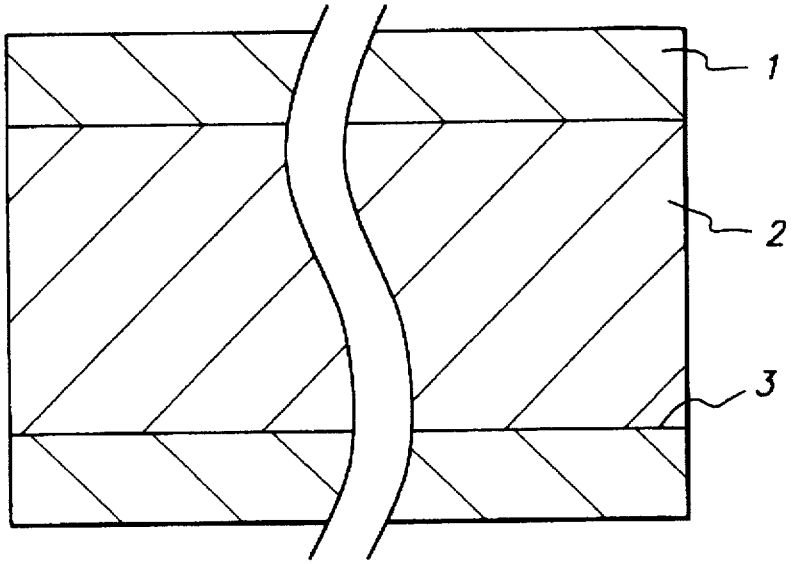
FIGS. 1 and 2 are diagrammatic longitudinal and transverse cross sections of an assembly of a core and a tube blank at the beginning of the method of the invention.

The cores used in this invention must provide satisfactory results both while the assembly of the tube blank and the core is being mechanically worked, and while the core is being converted into a stable stretched condition after the mechanical working is complete. The criteria for selecting a core metal which will enable the core to meet the mechanical working requirements are well known to those skilled in the art, and do not need detailed discussion here. For example, it is well known that the core metal and the tube metal preferably have substantially the same working characteristics, under the chosen working conditions, so that the extent to which the core is extruded out of, or sucked into, the tube, is limited. By contrast, the prior art does not address even the concept of removing a metal core from a metal tube by stretching, still less the criteria for selecting a core metal and a stretching method which will enable the core to be converted into a stable stretched condition. However, those skilled in the art will have no difficulty, having regard to the disclosure in this specification and their own knowledge, in choosing suitable core metals and stretching methods for the production of a wide range of metal tubes.

The suitability of a metal for use as the core depends upon, among other things, its stress/strain curve under the conditions of stretching and the ways in which the core can be treated, after a certain amount of stretching, so as to change its response to further stretching. It is important to remember that the stress/strain curve of a particular metal may be substantially changed by the conditions of stretching, in particular temperature, or by the previous thermo-mechanical history of the metal, in particular the presence of unrelieved stresses induced, for example, by mechanical working. For example, a particular core metal may give excellent results if a fully stress-relieved core is stretched in a single stretching step at a very low temperature, e.g. −60° C., but be of no value if the stress-relieved core is stretched at room temperature or if stresses induced by the mechanical working are not relieved prior to stretching.

The extent of the stretching needed in order to remove the core can also be an important factor in selecting a suitable core metal. The smaller the inner diameter of the tube, the greater the amount of stable elongation which must be imparted to the core in order to provide adequate clearance between the stretched core and the tube. For example, a particular core metal may give excellent results with a larger tube for which a stable elongation of only 10% is sufficient, but be of no value with a smaller tube for which a stable elongation of 20% is needed. We have found that if the tube has an interior diameter $D_2$ mm, the core is preferably stretched from a first length $L_0$ to a stable stretched length $L_2$ which is at least p times $L_0$, where $$p = \frac{D_2^2}{(D_2 - c)^2}$$

where c is at least 0.025 mm, preferably at least 0.05 mm.

When a metal is stretched, it first undergoes elastic deformation until the elastic limit is reached, usually at a very small strain, e.g. less than 1%, so that the stress/strain curve has an initial portion which slopes very steeply upwards. Many metals thereafter continue to stretch plastically at a single point, with little or no increase in stress, necking down at that point until breakage occurs; such metals cannot be used as core metals in this invention. Other metals, under at least some conditions, continue to stretch plastically as the stress is increased, and do not break until the stress has increased to a value substantially higher than the stress at the elastic limit. These metals can in general be converted into a stable stretched condition, as required by the present invention, by stretching under those conditions. A core of such a metal, when stretched beyond its elastic limit, first undergoes plastic elongation at one point (or at a limited number of points, typically at the ends of the core). However, it will not continue to stretch at that point (or at those points) if the force needed to stretch it further at that point becomes more than the sum of (a) the force needed to stretch the core at some other point and (b) the force needed to overcome the longitudinal component of the forces resulting from the interaction of the tube and the core at that other point. If, therefore, the sum of the forces (a) and (b) is less than that needed to break the core, the transference of the locus of stretching from point to point will continue until the whole of the core has been stretched to an extent which is set by the stretching force.

In some cases, the core can be stretched, without breaking, by a stress which is high enough (a) to permit the stretching force to be set at a substantially constant level which ensures that the whole core is stretched to an extent which permits its removal from the tube, or alternatively (b) to set the stretching force at a first level during a first step and at a second and higher level during one or more further steps, so that the whole core is stretched to an extent which permits its removal from the tube. This is referred to above as the first embodiment of the invention. In other cases, the core breaks before such a stress can be applied to it, or, for some other reason, the level of stress should be maintained relatively low. In those cases, the desired elongation of the core can often be achieved by a cyclic process in which the core is stretched at a first level of stress and is then stress-relieved by heating so that, after cooling, further stretching can be achieved by stretching the core at a second level of stress which is generally equal to or less than the first level, but can be more than first level. This cycle can be repeated a number of times. This method is referred to above as the second embodiment of the invention.

Preferred core metals are metals which, when stretched at at least one temperature in the range −100° to 200° C., preferably at at least one temperature in the range −80° C. to 100° C., particularly at at least one temperature in the range 10° to 30° C., in the form of a fully annealed sample (i.e. a sample which is free from stress), first stretches elastically until an elastic limit is reached, at which time the length of the sample is $S_1$ and the stretching force is $F_1$, and (ii) then stretches plastically, without breaking, until (a) the length of the sample is $S_2$, where $S_2$ is at least 1.03 $S_1$ preferably at least 1.06 $S_1$, more preferably at least 1.1 $S_1$, particularly at least 1.2 $S_1$, and (b) the stretching force reaches a second value $F_2$ which is at least 1.4 $F_1$, preferably at least 2.0 $F_1$, particularly at least 3.0 $F_1$, and/or which is at least ($F_1$+40,000) psi, preferably at least ($F_1$+60,000) psi.

In one preferred class of such core metals, the sample increases substantially in length, immediately after the elastic limit is exceeded, with little or no increase in stretching force; this plastic elongation may begin as localized plastic deformation which is evidenced by the formation of so-called Lüders lines. For example, the length of the sample may be at least 1.025 $S_1$, particularly at least 1.035 $S_1$, when the stretching force reaches ($F_1$+10,000) psi, and/or the length of the sample may be at least 1.04 $S_1$, particularly at least 1.05 $S_1$ when the stretching force reaches ($F_1$+15,000) psi. The stress/strain curve of such a metal, directly after the elastic limit, will have a much smaller slope than the initial part of the curve (and may be substantially flat or even decline). If this portion of the curve is too long and too flat, however, the stretching force may never reach a level which makes it possible to stretch the core throughout its length. It is, therefore, preferred that the stress/strain curve should exhibit a further upward portion as work hardening of the core increases its resistance to elongation. For example, the length of the sample is preferably less than 1.16 $S_1$ when the stretching force reaches a value of ($F_1$+60,000) psi, and/or less than 1.12 $S_1$ when the stretching force reaches a value of($F_1$+40,000) psi.

We prefer to use a core metal whose stress/strain curve has an intermediate portion of relatively small upward slope. However, we have also obtained good results with metals whose stress/strain curves show no such intermediate portion; for example the length of the sample may be less than 1.02 $S_1$ when the stretching force reaches ($F_1$+10,000) psi, and/or less than 1.04 $S_1$ when the stretching force reaches ($F_1$+15,000) psi.

As indicated above, the stress/strain curve of a metal depends not only upon the nature of the metal, but also upon any unrelieved stresses in the metal; and for this reason, the assembly of the core and the tube, after it has been mechanically worked to the desired tube dimensions, may be subjected to a treatment which relieves at least some of the unrelieved stresses in the core. An easy way of stress-relieving the core is to heat the whole assembly in an oven, e.g. to a temperature of about 600°–700° C. A characteristic of this method is that not only the core, but also the tube, is stress-relieved. This is a serious disadvantage if the objective is a work-hardened tube. A preferred alternative, under these circumstances, is to stress-relieve the core by passing an electric current through the core so that it heats to an elevated temperature, e.g. 300°–500° C., which may be substantially lower than 700° C. Such resistance heating of the core usually results in the tube being heated to a lower temperature than the core, and the resistance heating can be adjusted so that any stress-relieving of the tube does not deprive the tube of its desired final properties. This type of stress-relieving may result in a core having a stress/strain characteristic which is less satisfactory, for the purposes of stretching to enable removal, than a core that has been annealed in an oven. For example a core which can be stretched sufficiently in a single step (as in the first embodiment) after annealing in an oven at 700° C., may break, before it can be stretched sufficiently, if it has been stress-relieved by resistance heating at 400° C. However, in such a case, the core can be stretched in accordance with the second embodiment of the invention, i.e. in two or more stretching steps separated by steps in which the stretched core is stress relieved by resistance heating of the core (again under conditions such that any stress-relieving of the tube does not deprive the tube of its desired properties).

Metals which can be used as core metals in this invention include metals which fall into a least one of the following categories.

(1) Shape memory metals, i.e. metals which can exist in an austenitic state and in a martensitic state, and which undergo a transition from the austenitic state to the martensitic state when cooled, the transition beginning at a higher temperature $M_s$ and finishing at a lower temperature $M_f$. A core of such a metal is preferably stretched at a temperature below $M_s$, for example at a temperature between $M_s$ and $M_f$, since the stress/strain curve immediately above the elastic limit is usually longer and of smaller slope at such temperatures. Since it is convenient to carry out the stretching at or near room temperature, preferred metals are those having an $M_s$–$M_f$ range which includes at least one temperature in the range 0°–50° C., preferably 20°–300° C., e.g. 23° C.

(2) Alloys of nickel and titanium, including both binary alloys and alloys containing one or more other metals in addition to nickel and titanium, for example one or more of iron, cobalt, manganese, chromium, vanadium, molybdenum, zirconium, niobium, hafnium, tantalum, tungsten, copper, silver, gold and aluminum. Many such alloys also fall into category (1).

A preferred binary alloy comprises 55.5 to 56.0%, preferably about 55.5%, nickel and 44 to 44.5%, preferably about 44.5%, titanium, since it can be stretched at room temperature. Throughout this specification the percentages given for ingredients of alloys are by weight, based on the weight of the alloy. Binary alloys containing more than about 44.5% titanium, e.g. 44.5 to 47% titanium, the balance nickel, can also be used, but when using such alloys, it may be necessary to carry out steps (C) and (D) above room temperature.

The addition of certain metals to nickel-titanium alloys will reduce the $M_f$ value of the alloy. Accordingly, another preferred class of alloys contains more than about 44.5% titanium, e.g. 44.5 to 47% titanium, an effective amount of one or more of iron, cobalt, manganese, chromium, vanadium, zirconium, niobium, molybdenum, hafnium, tantalum and tungsten, and the balance nickel. The term "effective amount" is used to denote an amount which is sufficient to result in an alloy having an $M_s$–$M_f$ range which includes room temperature, generally 0.1 to 2%.

There are other metals which can be added to nickel titanium alloys and which leave the $M_s$–$M_f$ range unchanged or which slightly increase the $M_s$–$M_f$ range. Such metals include copper, silver and gold, and they can usefully be present in the alloy in order to reduce the stretching forces required for further stretching above the elastic limit and/or in order to reduce the temperature needed to stress relieve the core, either between cold drawing steps during the mechanical working and/or between the stretching steps. Typically such metals are present in amount about 0.1 to 20% in an alloy containing 44 to 44.5% titanium, with the balance nickel.

Another useful class of nickel titanium alloys consists essentially of 41 to 47% titanium, 0.1 to 5% aluminum, and the balance nickel. The presence of the aluminum produces an alloy which can be subjected to precipitation hardening.

(3) The alloys (many of which are nickel titanium alloys) which are described in U.S. Pat. No. 4,935,068 (Duerig, assigned to Raychem), the entire disclosure of which is incorporated herein by reference. Cores composed of such alloys can be alternately cold drawn and stress-relieved below the recrystallization temperature, thus elongating them in accordance with the second embodiment of the invention, and simulating an alloy whose stress/strain curve has a long flat portion directly after the elastic limit.

(4) Low carbon steels, particularly carbon manganese steels such as 1018 steel and low alloy steels such as 4130 steel.

Tube Metals

The invention can be used to make a tube of any metal whose working characteristics enable the tube blank and the core to be elongated by mechanical working. Examples of suitable tube metals include alloys containing titanium, and one or more other metals, e.g. nickel, aluminum, vanadium, niobium, copper, and iron. In one class of such alloys, the titanium is present in amount at least 80%, preferably 85 to 97%, and the alloy also contains one or both of aluminum and vanadium, for example the alloy containing about 90% Ti, about 6% Al and about 4% V, and the alloy containing about 94.5% Ti, about 3% Al and about 2.5% V. In another class of such alloys, the titanium is present in amount 35 to 47% and the alloy also contains about 42 to about 58% nickel, 0 to about 4% iron, 0 to about 13% copper and 0 to about 17% niobium. Other titanium nickel alloys which can be used as tube metals include those disclosed herein as being suitable for use as core metals. Other tube metals include reactive metals and alloys (i.e. metals and alloys which will react with oxygen and/or nitrogen if subjected to mechanical working in air and which must, therefore be processed in an inert medium or within a non-reactive shell, e.g. of stainless steel, which is removed at any convenient stage after the mechanical working is complete), including in particular titanium, zirconium and hafnium. Other tube metals include intermetallic compounds, e.g. nickel aluminides and titanium aluminides, many of which are difficult to work at room temperature and must be worked at the elevated temperatures at which they are ductile.

Assemblies

The dimensions of the tube blank and the core in the initial assembly are determined by the dimensions which are required in the finished tube and the equipment available for the mechanical working of the assembly. These are matters well known to those skilled in the art, and do not require detailed description here. For example, the core and tube blank can have a length of 3 to 100 inch (76 to 2500 mm), e.g. 12 to 48 inch (300 to 1220 mm); the outer diameter of the tube blank can be 0.75 to 2 inch (10 to 51 mm), preferably 1 to 1.5 inch (25 to 40 mm); the diameter of the core and the inner diameter of the core blank can be 0.3 to 1 inch (7.6 to 25.5 mm), preferably 0.5 to 0.9 inch (12.5 to 23 mm); and the ratio of the outer diameter of the tube to the inner diameter of the tube can be from 1.01 to 2.5, preferably 1.4 to 2.0. It is advantageous to use a blank which is as long as possible, since this minimizes the proportion of the assembly which forms the nose (to enter the dies used in the mechanical working) and which does not, therefore, provide useful product. Except in the nose portion, the ratio of the inside diameter of the tube product to the outside diameter of the tube product is substantially the same as in the tube blank.

We have found that improved results are obtained in the stretching of the core and removal of the stretched core if a lubricant is placed between the tube blank and the core in the initial assembly. For example, we have used graphite, which is preferred, and molybdenum disulfide as lubricants.

Mechanical Working of the Assembly of the Tube Blank and the Core

In the first step of the process, an assembly of the tube blank and the core is subjected to mechanical working so as to elongate the assembly until the tube has the desired final dimensions. Such procedures, involving multiple drawing through dies of ever-decreasing diameter, at high temperatures and/or at lower temperatures with annealing after low temperature drawing steps, are well known to those skilled in this art, and do not require further description here.

After the core and the tube blank have been elongated by mechanical working, the elongated assembly is cut into lengths which can be conveniently handled in available equipment such as a draw bench. The elongated assembly may have a length of at least 100 meters, and be cut into lengths of less than 35 meters. Unless the final mechanical working step is carried out at an elevated temperature such that the core is sufficiently free of stress to be stretched, the core must be annealed. The annealing can be carried out either before or after the assembly is cut up into sections. The nosed end section of the assembly is discarded, and so is the opposite end section insofar as it contains only the tube or only the core, because of their different mechanical working characteristics.

Stretching of the Core

The core can sometimes be stretched in a single continuous pull; an equivalent procedure is to stretch the core in two or more steps with no treatment in between the steps. In other cases, it is necessary or desirable (to reduce the likelihood of premature breakage of the core) to stretch the core in two or more steps, with an intermediate modification step (usually a heat treatment) which improves the response of the core to further stretching. If the stretching force is maintained during the modification step, further stretching may occur during the modification step, for example as a shape memory metal cools to below its $M_s$ temperature.

DETAILED DESCRIPTION OF THE DRAWINGS

Figure 2:
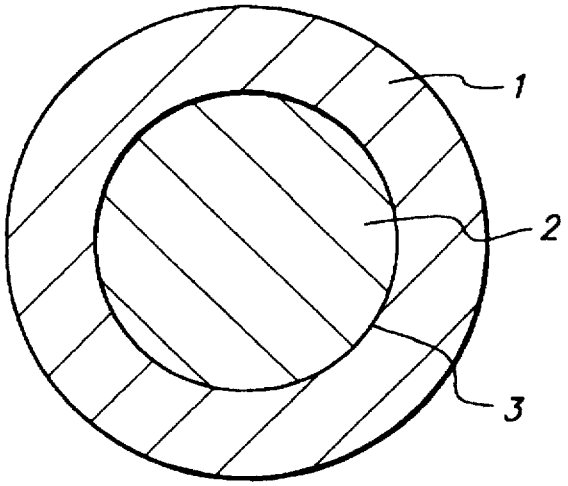
Figure 3:
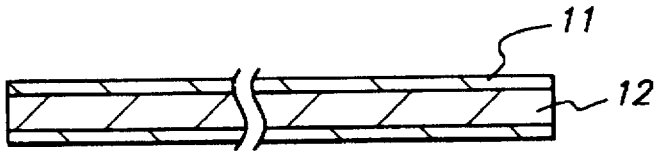
FIG. 3 is a diagrammatic longitudinal cross section through an assembly which has been elongated by mechanical working.

Referring now to the drawings. FIGS. 1 and 2 show an assembly which is suitable for use as a starting material in this invention and which comprises a tube blank 1 surrounding a core 2. Between the tube blank and the core is a very thin layer 3 of a lubricant. FIG. 3 shows an elongated assembly which has been prepared by mechanical working of the initial assembly shown in FIGS. 1 and 2, and which comprises a tube 11 and an elongated core 12.

Figure 4:
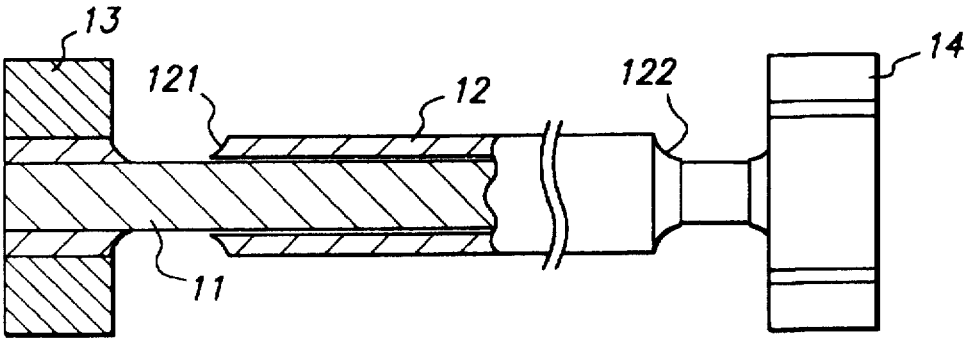
FIG. 4 is a diagrammatic view, partly in cross section, of an assembly which is as shown in FIG. 3 except at a larger scale, and the core of which is being stretched so that it can be removed.

FIG. 4 shows the stretching of the core of a section cut from an elongated assembly as shown in FIG. 3. The tube 12 is scored circumferentially at locations 121 and 122 a little way from each end, and the end sections, outside the score lines, are firmly gripped by the jaws 13, 14 of a draw bench. The jaws are drawn apart, first causing the tube to break at the score lines and then stretching the core until it has thinned sufficiently to be removed from the tube.

Figure 5:
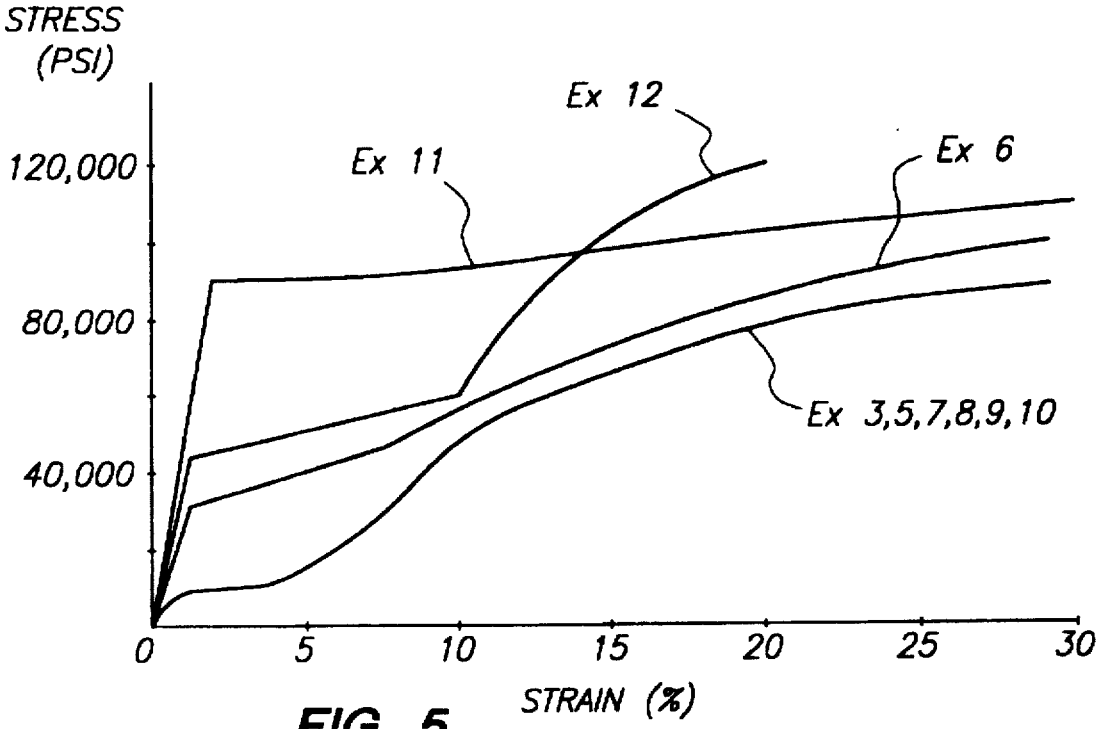
FIG. 5 shows the stress/strain curves of various metals which were used, under appropriate conditions, as core metals in the Examples given below.

FIG. 5 shows the stress/strain curves of the core metals used in many of the Examples below.

Figure 6:
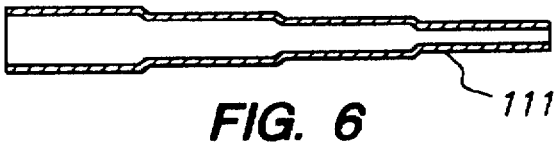
FIGS. 6 and 7 are diagrammatic longitudinal cross sections through tapered tubes of the invention.
Figure 7:
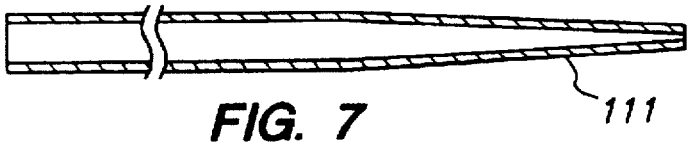

FIGS. 6 and 7 show tubes of the invention comprising a tapered portion 111.

EXAMPLES

The invention is illustrated by the following Examples. In each of the Examples, the procedure set out below was followed so far as possible. As discussed below, in some of the Examples, it was not possible to complete the procedure.

A tube blank, 18 inch (457.2 mm) long, 1.25 inch (31.74 mm) outside diameter, and 0.75 inch (19.05 mm) inside diameter (i.e. a ratio of outer to inner diameter of 1.67), was prepared from the Tube Metal specified in the Table below. A core, 24 inch (610 mm) long and diameter 0.745 inch (18.923 mm), was prepared from the Core Metal specified in the Table, coated with the Lubricant specified in the Table (where M is an abbreviation for molybdenum disulfide, and G is an abbreviation for graphite), and inserted into the tube blank. The assembly was annealed at 750° C. in Examples 1–7, 9 and 10 and at 825° C. in Examples 8, 11 and 12. The annealed assembly was nosed, and then drawn to the final diameter shown in the Table. In the Examples in which the final diameter was 1.27 mm or more, the assembly was first hot drawn at 500° C. through a succession of graphite-lubricated tungsten carbide dies to a diameter of 17.35 mm; then cold drawn to a diameter of 6.1 mm through a succession of graphite-lubricated tungsten carbide dies, with annealing after each drawing step, the annealing being at 750° C. in Examples 1–7, 9, and 10 and at 825° C. in Examples 8, 11 and 12; and then cold drawn to the final diameter through a succession of graphite-lubricated tungsten carbide dies, with strand annealing of the assembly after each drawing step by running it through a furnace 1.83 m long at 750° C. at 7.6 m/min. In Example 3, (final diameter 0.64 mm), the assembly was further cold drawn to a diameter of 0.84 mm through a succession of graphite-lubricated tungsten carbide dies, with strand annealing as before, and finally was cold drawn through a succession of oil-lubricated diamond dies.

The Table also shows the ratio of the final outer diameter of the tube to the final inner diameter of the tube. In some Examples, this ratio is substantially less than the initial ratio of 1.67, reflecting the fact that the different working characteristics of the tube and the core have caused the tube to become longer than the core, and in Example 6, this ratio is 1.8, reflecting the fact that the different working characteristics have caused the core to become longer than the tube. In each of the Examples, the drawn assembly was strand annealed while it was under a load of about 10 lb. (4,500 g), by running it through a furnace at 40 ft/min. (12.19 m/min.), the furnace having an argon atmosphere, being at 550° C., and about 8 ft. (2.4 m) long.

The drawn assembly was cut into lengths of 13 ft (3.96 m), after discarding the nose section and any end sections of the assembly which do not contain both core and tube. At each end of each length, the tube wall was scored circumferentially about 1 inch (2.5 cm) from the end of the assembly. The end sections of the tube (outside the score lines) and the ends of the core inside them were firmly gripped in a draw bench, and were pulled apart in a single stretching step. The ends of the tube, outside the score lines, broke off immediately and the stretching of the core was continued until the core broke or had undergone sufficient plastic stretching (about 12–15%) to be pulled out of the tube. The stretching and removal of the core were carried out at room temperature (about 23° C.), except in Example 12, in which they were carried out at −65° C.

In Examples 1, 10 and 11, the core broke before it could be stretched enough to permit its removal. In Examples 2 and 4, the core was removed, but removal was difficult. In Examples 3, 5, 6, 8, 9 and 12, the core was removed, and there was no difficulty in removing the core from the tube. In Example 7, the procedure was finished when the tube cracked, the external diameter of the assembly then being about 5.08 mm. It is to be noted that Example 8 (in which the core was removed) is the same as Example 7, except that in Example 8 the annealing temperatures were 825° C. instead of 750° C. It is also to be noted that Example 9 (in which the core was removed) is very similar to Example 10 (in which the core could not be removed), except that in Example 10 no lubricant was used between the core and the tube. It is also to be noted that Example 11 (in which the core could not be removed) is the same as Example 12 (in which the core was removed), except that the stretching and removal of the core were carried out at 23° C. in Example 11 and at −65° C. in Example 12; FIG. 5 shows how different the stress/strain curves of the core metal are at 23° C. and −65° C.

TABLE

| Ex. No. | Tube Metal | Core Metal | Lubricant | Final Diam. (mm) | Final Ratio | Success |
|---|---|---|---|---|---|---|
| 1 | Ni 55.84<br>Ti 44.16 | 1018 Steel | M | 2.79 | 1.65 | No<br>(core broke) |
| 2 | As Ex. 1 | 4130 Steel | M | 2.79 | 1.45 | Yes |
| 3 | As Ex. 1 | Ni 43.67<br>Ti 44.51<br>Cu 11.82 | M | 0.64 | 1.33 | Yes |
| 4 | As Ex. 1 | Ni 54.475<br>Ti 45.525 | M | 1.27 | 1.43 | Yes |
| 5 | Ni 54.65<br>Ti 44.30<br>Fe 1.04 | As Ex. 3 | M | 1.52 | 1.5 | Yes |
| 6 | Ni 48.383<br>Ti 36.955<br>Nb 14.576 | Ni 55.84<br>Ti 44.16 | G | 2.29 | 1.8 | Yes |
| 7 | As Ex. 6 | As Ex. 3 | G | 5.08 | 1.56 | No |

TABLE-continued

| Ex. No. | Tube Metal | Core Metal | Lubricant | Final Diam. (mm) | Final Ratio | Success |
|---|---|---|---|---|---|---|
| | | | | | | (tube cracked) |
| 8 | As Ex. 6 | As Ex. 3 | G | 2.21 | 1.61 | Yes |
| 9 | Ni 55.1 Ti 44.9 | As Ex. 3 | G | 1.52 | 1.3 | Yes |
| 10 | As Ex. 1 | As Ex. 3 | None | 2.79 | 1.65 | No (core broke) |
| 11 | As Ex. 1 | Ni 48.383 Ti 36.955 Nb 14.576 | G | 2.21 | 1.58 | No (core broke) (at 23° C.) |
| 12 | As Ex. 1 | As Ex. 11 | G | 2.21 | 1.58 | Yes (at −65° C.) |

We claim:

1. A method of making an elongated seamless metal tube of I.D. of 0.005 to 0.5 in (0.13–12.7 mm) and with wall thickness of 0.002–0.2 in (0.05–5 mm) of material selected from the group consisting of:

(a) alloys comprising a metal selected from the class consisting of nickel and reactive metals (titanium, niobium, tantalum, zirconium and/or hafnium) as a principal alloy ingredient and one or more additional alloy ingredients selected from the class consisting of aluminum, vanadium, nickel, iron, copper and niobium, (b) nickel aluminide and titanium aluminide, and (c) one or more of the elements, titanium, zirconium, hafnium comprising steps of:

(1) forming a tubular blank of the metal assembled into an assembly with a metal core surrounded and contacted by the tubular blank, the core metal being capable of stable elongation—elongation with uniform reduction of cross section area in relation to the degree of elongation—with a greater degree of reduction than the tube blank or the same degree of reduction depending on applied conditions, the metal of the core having an elongation capability as described at (3) below when worked as described in (2) and (3), below, (2) elongating the assembly by mechanical working until the tube is reduced in cross section area outer diameter compared to the original billet assembly and the tube wall thickness is correspondingly reduced compared to the original tubular blank, but in a way that avoids metallurgical or chemical bonding at the tubular blank/core interface, and then (3) further elongating the core by mechanical working, but in a way that causes its elongation and corresponding cross area reduction to a greater degree than any concomitant elongation and cross section area reduction of the tube with such elongation/reduction retained when stretching forces are withdrawn so that a clearance is developed between the tube and core enabling longitudinal core removal, and then removing the core.

2. A method according to claim 1 wherein the core is composed of a metal which, when stretched by subjecting to a stretching force under the conditions in step (C) as a fully annealed sample, (i) first stretches elastically until an elastic limit is reached, at which time the sample has a tenth $S_1$ and the stretching force is $F_1$, and (ii) then stretches plastically, without breaking, until (a) the length of the sample reaches a second value $S_2$ which is at least 1.06 $S_1$ and (b) the stretching force reaches a second value $F_2$, where $F_2$ is at least 1.4 $F_1$.

3. A method according to claim 2 wherein $F_2$ is at least 3.0 $F_1$ and $S_2$ is at least 1.2 $S_1$.

4. A method according to claim 3 wherein step (C) comprises stretching the core until its length is at least 1.15 $S_1$, the stretching being carried out in a single step or in two or more steps without any treatment between the steps which substantially changes the response of the core to further stretching.

5. A method according to claim 4 wherein the length of the sample is at least 1.03 $S_1$ when the stretching force is ($F_1$+10,000) psi.

6. A method according to claim 4 wherein the length of the sample is less than 1.03 $S_1$ when the stretching force is ($F_1$+10,000) psi.

7. A method according to claim 2 wherein step (C) comprises in sequence (1) stretching the core, (2) heating the stretched core from step (1), thereby removing at least some of the stresses in the core, and (3) cooling and stretching the core from step (2).

8. A method according to claim 7 wherein the core is stretched while it is cooling.

9. A method according to claim 7 wherein the core is stretched after it has cooled.

10. A method according to claim 7 wherein (i) a work-hardened tube is prepared in step (B), (ii) the assembly from step (B) is subjected to a treatment which removes at least some of the stresses from the core but does not remove all of the stresses from the tube produced in step (B), and (iii) in step (2) the heating of the stretched core does not remove all the stresses from the tube produced in step (B).

11. A method according to claim 1 wherein the tube, after step (B), has an inner diameter $D_2$ mm, and in step (C), the core is stretched from a first length $L_0$ mm to a stable stretched length $L_2$ mm which is at least p times $L_0$, where $$p = \frac{D_2^2}{(D_2 - 0.025)^2}.$$

12. A method according to claim 11 wherein $D_2$ is at most 12.7 mm.

13. A method according to claim 1 wherein the core is composed of a shape memory metal having a martensite start temperature $M_s$ and a martensite finish temperature $M_f$ and wherein the core is at a temperature below $M_s$ when it is stretched in step (C).

14. A method according to claim 13 wherein the core is at a temperature between $M_s$ and $M_f$ when it is stretched in step (C).

15. A method according to claim 13 wherein the core is at a temperature below $M_f$ when it is stretched in step (C).

16. A method according to claim 1 wherein the core is composed of an alloy comprising nickel and titanium.

17. A method according to claim 1 wherein the core is composed of an alloy selected from the group consisting of (1) alloys consisting essentially of nickel in amount 55.5 to 56.0% and titanium in amount 44 to 44.5%, (2) alloys consisting essentially of titanium in amount 44.5 to 47%, 0.1 to 2% of one or more of iron, cobalt, manganese, chromium, vanadium, zirconium, niobium, molybdenum, hafnium, tantalum and tungsten, and the balance nickel; and (3) alloys consisting essentially of titanium in amount 44 to 44.5%, 0.1 to 20% of one or more of copper, silver and gold, and the balance nickel.

18. A method according to claim 1 wherein the tube blank is composed of a metal selected from the group consisting of (1) alloys comprising nickel and titanium, (2) alloys containing at least 80% titanium, (3) titanium, (4) zirconium, (5) hafnium, (6) nickel aluminide, and (7) titanium aluminide.

19. A method according to claim 1 wherein there is a lubricant between the core and the tube blank.

20. A method according to claim 1 wherein the assembly, immediately after step (B), has a length of at least 100 meters, and is cut into lengths of less than 35 meters prior to step (C).

21. A method according the claim 1 wherein the elongated assembly from step (B) is cut into discrete lengths, at least one of the discrete lengths is subjected to a mechanical treatment which results in a continuous or stepped taper over at least part of the assembly, and step (C) is carried out on the tapered assembly.

* * * * *